US010505269B2

(12) United States Patent
Hong et al.

(10) Patent No.: US 10,505,269 B2
(45) Date of Patent: Dec. 10, 2019

(54) MAGNETIC ANTENNA STRUCTURES

(71) Applicants: Yang-Ki Hong, Tuscaloosa, AL (US); Jaejin Lee, Tuscaloosa, AL (US)

(72) Inventors: Yang-Ki Hong, Tuscaloosa, AL (US); Jaejin Lee, Tuscaloosa, AL (US)

(73) Assignee: The Board of Trustees of the University of Alabama for and on behalf of the University of Alabama, Tuscaloosa, AL (US)

( * ) Notice: Subject to any disclaimer, the term of this patent is extended or adjusted under 35 U.S.C. 154(b) by 0 days.

(21) Appl. No.: 14/263,251

(22) Filed: Apr. 28, 2014

(65) Prior Publication Data

US 2014/0320365 A1 Oct. 30, 2014

Related U.S. Application Data

(60) Provisional application No. 61/816,766, filed on Apr. 28, 2013.

(51) Int. Cl.
*H01Q 1/52* (2006.01)
*H01Q 1/38* (2006.01)
(Continued)

(52) U.S. Cl.
CPC ..... *H01Q 1/38* (2013.01); *H01Q 1/20* (2013.01); *H01Q 1/243* (2013.01); *H01Q 1/521* (2013.01); *H01Q 9/42* (2013.01); *H01Q 21/28* (2013.01)

(58) Field of Classification Search
CPC ..... H01Q 1/38; H01Q 1/20; H01Q 1/243; H01Q 1/521; H01Q 9/42; H01Q 21/28; H01Q 1/36; H01Q 7/08; H01Q 5/357; H01Q 7/06; H01Q 1/526; H01Q 1/40; H01Q 3/44
(Continued)

(56) References Cited

U.S. PATENT DOCUMENTS 4,464,663 A 8/1984 Lalezari et al.
5,327,148 A * 7/1994 How ..... H01Q 3/44 343/700 MS
(Continued)

FOREIGN PATENT DOCUMENTS

CN 101472855 7/2009

OTHER PUBLICATIONS

Nian Sun et al., IEEE Transactions on Magnetics (vol. 48, No. 11).*
(Continued)

*Primary Examiner* — Hoang V Nguyen
*Assistant Examiner* — Awat M Salih
(74) *Attorney, Agent, or Firm* — Maynard Cooper & Gale, P.C.; Jon E. Holland

(57) ABSTRACT

A magnetic antenna structure has a substrate (e.g., a flexible printed circuit board (PCB) carrier), a magneto-dielectric (MD) layer, and an antenna radiator. The MD layer increases electromagnetic (EM) energy radiation by lowering the EM energy concentrated on the antenna substrate. The resonant frequency and antenna gain of the magnetic antenna structure are generally lower and higher, respectively, relative to dielectric antennas of comparable size. Thus, the magnetic antenna structure provides better miniaturization and high performance with good conformability.

16 Claims, 9 Drawing Sheets

(51) Int. Cl.

| | |
|---|---|
| ***H01Q 1/20*** | (2006.01) |
| ***H01Q 1/24*** | (2006.01) |
| ***H01Q 9/42*** | (2006.01) |
| ***H01Q 21/28*** | (2006.01) |

(58) Field of Classification Search
USPC ..... 343/787, 702, 788, 742, 893, 841; 212/83
See application file for complete search history.

(56) References Cited

U.S. PATENT DOCUMENTS 5,638,080 A 6/1997 Orthmann et al.
6,008,775 A 12/1999 Bobowicz et al.
7,495,625 B2 * 2/2009 Endo ..... G06K 7/10336 340/572.5
7,777,677 B2 8/2010 Bungo
7,859,471 B2 12/2010 Bungo
7,924,235 B2 4/2011 Fujimoto et al.
8,253,643 B2 8/2012 Kato
8,422,190 B2 * 4/2013 Ito ..... H01F 17/0006 361/119
8,466,791 B2 * 6/2013 Goto ..... H01Q 7/00 340/572.7
8,614,648 B2 * 12/2013 Kojima ..... H01Q 7/06 340/572.5
8,749,439 B2 * 6/2014 Rao ..... H01Q 21/30 343/725
2007/0080866 A1 * 4/2007 Hayakawa ..... H01Q 3/44 343/700 MS
2008/0224937 A1 * 9/2008 Kimura ..... C04B 35/265 343/787
2009/0115673 A1 5/2009 Nysen
2009/0121955 A1 5/2009 Kubo
2009/0273534 A1 11/2009 Gonda
2009/0315798 A1 * 12/2009 Nam ..... H01Q 1/243 343/787
2010/0053014 A1 3/2010 Yosui et al.
2010/0277387 A1 11/2010 Schantz
2010/0289708 A1 11/2010 Bungo
2011/0001682 A1 1/2011 Rao
2011/0234014 A1 * 9/2011 Kato ..... H01F 27/365 307/104
2012/0062435 A1 * 3/2012 Kato ..... H01Q 7/06 343/787
2012/0139792 A1 * 6/2012 Pan ..... H01Q 1/243 343/700 MS
2012/0235881 A1 * 9/2012 Pan ..... H01Q 1/20 343/893
2012/0268335 A1 * 10/2012 Zhang ..... H01Q 1/243 343/787
2012/0287012 A1 * 11/2012 Aizawa ..... H01Q 1/243 343/853
2013/0021215 A1 * 1/2013 Suzuki ..... B29C 45/14 343/787
2013/0033406 A1 * 2/2013 Chae ..... H01Q 1/38 343/787
2013/0076580 A1 * 3/2013 Zhang ..... H01Q 1/243 343/720
2013/0187819 A1 * 7/2013 Wakasugi ..... B32B 9/005 343/787
2013/0267170 A1 * 10/2013 Chong ..... H04B 1/3833 455/41.1
2014/0055319 A1 * 2/2014 Cho ..... H01Q 1/243 343/893
2015/0002367 A1 * 1/2015 Kosaka ..... H01Q 1/523 343/893
2015/0123604 A1 * 5/2015 Lee ..... H01F 38/14 320/108

OTHER PUBLICATIONS

Permittivity and Permeability Measurement of Spin-Spray Deposited Ni—Zn-Ferrite Film Sample, by Chao et al.*
Yang, L., et al., "Design and Development of Compact Conformal RFID Antennas Utilizing Novel Flexible Magnetic Composite Materials for Wearable RF and Biomedical Applications," Antennas and Propagation Society International Symposium, 2008. AP-S 2008. IEEE , vol., No., pp. 1,4, Jul. 5-11, 2008.
Martin, L. J., et al., "Effect of Permittivity and Permeability of a Flexible Magnetic Composite Material on the Performance and Miniaturization Capability of Planar Antennas for RFID and Wearable Wireless Applications," IEEE Trans. Antennas Propag., vol. 32, p. 849, 2009.
Hong, et al., U.S. Appl. No. 14/092,414, entitled, "Dual-Polarized Magnetic Antennas," filed Nov. 27, 2013.
Written Opinion of the International Searching Authority issued by the United States Patent and Trademark Office as the International Searching Authority for International Application No. PCT/US2013/072341, entitled Dual-Polarized Magnetic Antennas; Copenheaver, Blaine (Feb. 9, 2014).

* cited by examiner

MAGNETIC ANTENNA STRUCTURES

CROSS REFERENCE TO RELATED APPLICATION

This application claims priority to U.S. Provisional Patent Application No. 61/816,766, entitled "Flexible Magnetic Antenna Structures" and filed on Apr. 28, 2013, which is incorporated herein by reference.

RELATED ART

Wireless communication products and services are growing at a rapid pace due in part to increase demands for mobile or handheld electronic devices. In order to enhance mobility and decrease power requirements, techniques are constantly evolving to reduce the overall size or footprint of wireless communication devices, and further size reductions are generally desired. Antenna structures often occupy a significant amount of real estate within a wireless communication product, such as a radio or cellular telephone, and a relatively large number of antenna structures may be embedded in some wireless communication products. To help reduce the footprint of wireless communication products, it is generally desirable to decrease the size of the antenna structure or structures without significantly decreasing antenna bandwidth or gain.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

The present disclosure generally relates to magnetic antenna structures, such as single-input, single output (SISO) or multiple-input, multiple-output (MIMO) antenna structures, for wireless communication. In one embodiment, a flexible magnetic antenna structure comprises a flexible printed circuit board (PCB) carrier, a magneto-dielectric (MD) layer, and an antenna radiator. The MD layer increases electromagnetic (EM) energy radiation by lowering the EM energy concentrated on the flexible PCB carrier. The resonant frequency and antenna gain of the flexible magnetic antenna structures described herein are generally lower and higher, respectively, relative to flexible dielectric antennas of comparable size. Thus, the flexible magnetic antenna structures provide better miniaturization and high performance with good conformability.

Figure 1:
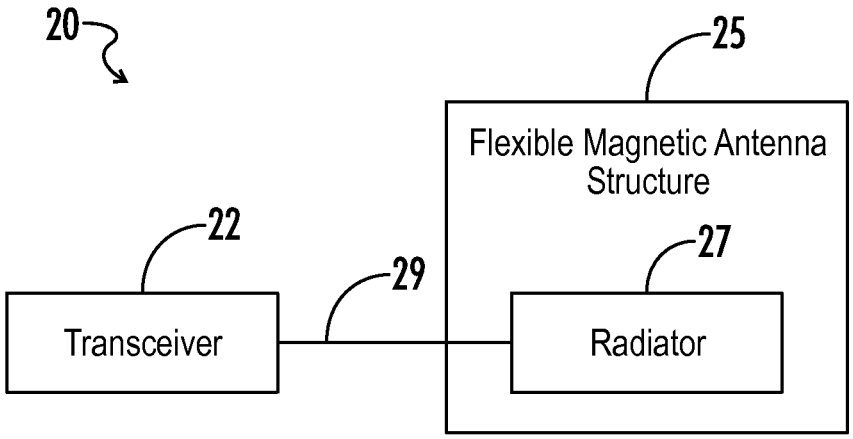
FIG. 1 is a block diagram illustrating an exemplary embodiment of a wireless communication system.

FIG. 1 depicts an exemplary embodiment of a wireless communication system 20 having a transceiver 22 that is coupled to a flexible magnetic antenna structure 25. In particular, the transceiver 22 is conductively coupled to a conductive radiator 27 via a conductive connection 29 (e.g., a wire or cable). When transmitting, the transceiver 22 transmits to the structure 25 an electrical signal that wirelessly radiates from the radiator 27 for reception by a remote transceiver (not shown). An electrical signal wirelessly transmitted from a remote transceiver (not shown) is received by the radiator 27 and passed to the transceiver 22 via the connection 29. Note that various types of transceivers 22 are possible, such as Frequency Modulation (FM) radios, network transceivers (e.g., 2G, 3G, or 4G), Global Positioning System (GPS) transceivers, Bluetooth transceivers, Wireless Local Area Network (WLAN) transceivers, dedicated short-range communication transceivers, and other types of known wireless transceivers.

Figure 2:
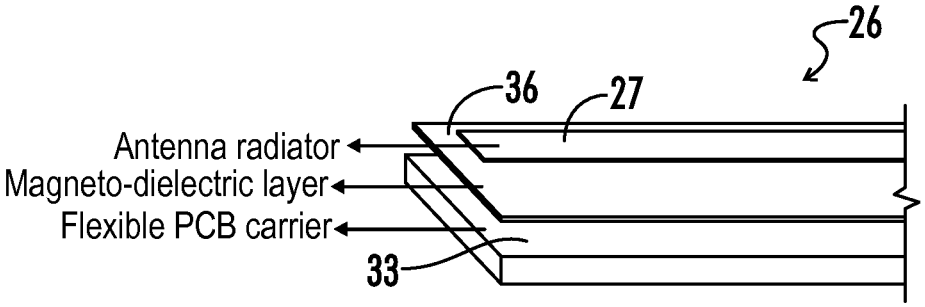
FIG. 2 is an exploded view depicting an exemplary embodiment of a flexible magnetic antenna structure.

FIG. 2 depicts an exemplary embodiment of a flexible magnetic antenna structure 26. As shown by FIG. 2, the structure 26 has a flexible substrate 33. In one embodiment, the substrate 33 is a flexible printed circuit board (PCB) and shall be referred to as the "flexible PCB carrier," but other types of flexible or non-flexible substrates 33 are possible in other embodiments. The flexible PCB carrier 33 is composed of a dielectric material, such as Kapton polymide, polyvinyl chloride (PVC), polyurethane form, or polyethylene terephthalate (PET). A magnetic layer 36 is formed on the flexible PCB carrier 33, and the radiator 27 is formed on the magnetic layer 36. The magnetic layer 36 is magneto-dielectric and shall be referred to hereafter as a "magneto-dielectric (MD) layer." The material of the MD layer 36 has a relative permeability ($\mu_r$) and a relative permittivity ($\varepsilon_r$) both greater than 1. In one embodiment, the MD layer 36 is a spinel ferrite (e.g., Ni—Zn, Mn—Zn, Ni—Zn—Cu, Ni—Mn—Co, Co, Li—Zn, and/or Li—Mn ferrites), hexagonal ferrite (e.g., M-, Y-, Z-, X-, and/or U-type), and/or other magnetic composite. A structure 26, such as is depicted by FIG. 2, in which an MD layer 36 is formed between the radiator 27 and the PCB carrier 33 with no MD layer on top of the radiator 27 shall be referred to herein as a "substrate structure."

Figure 3:
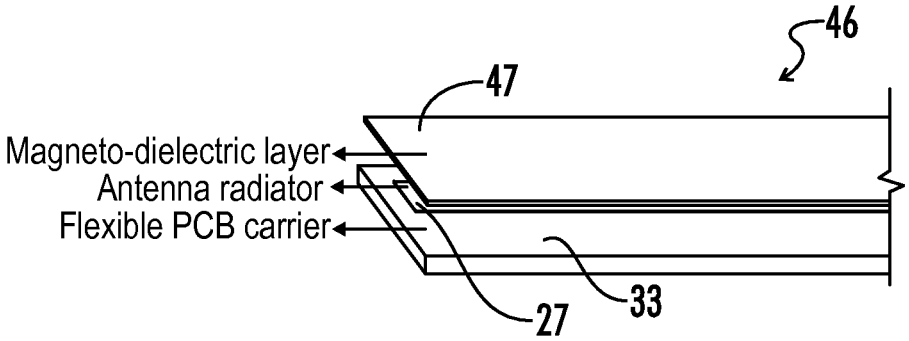
FIG. 3 is an exploded view depicting another exemplary embodiment of a flexible magnetic antenna structure.

FIG. 3 depicts another exemplary embodiment of a flexible magnetic antenna structure 46. As can be seen by comparing FIGS. 2 and 3, the structure 46 of FIG. 3 is similar to the substrate structure 26 shown by FIG. 2 except that an MD layer 47 is formed on top of the radiator 27 instead of between the radiator 27 and the PCB carrier 33. That is, the radiator 27 is between the MD layer 47 and the PCB carrier 33. Like the MD layer 36 of FIG. 2, the MD layer 47 of FIG. 3 is composed of magnetic material having a relative permeability ($\mu_r$) and a relative permittivity ($\varepsilon_r$) both greater than 1. A structure 46, such as is depicted by FIG. 3, in which an MD layer 47 is formed on top of the radiator 27 with no MD layer between the radiator 27 and the PCB carrier 33 shall be referred to herein as an "overleaf structure."

Figure 4:
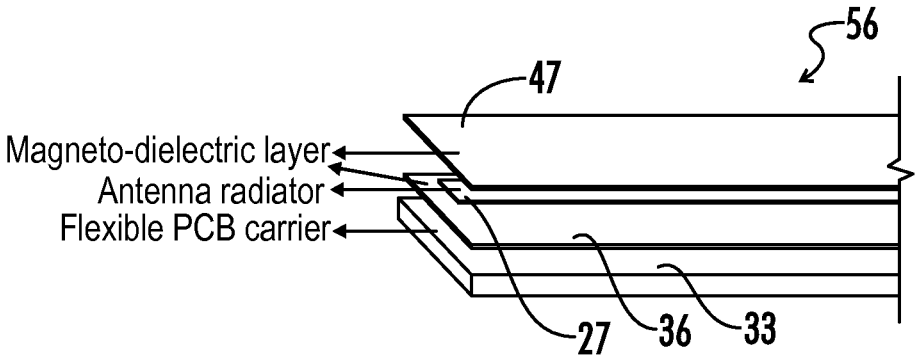
FIG. 4 is an exploded view depicting yet another exemplary embodiment of a flexible magnetic antenna structure.

FIG. 4 depicts another exemplary embodiment of a flexible magnetic antenna structure 56. As can be seen by comparing FIGS. 2-4, the structure 56 of FIG. 4 is similar to the substrate structure 26 shown by FIG. 2 and the overleaf structure 46 shown by FIG. 3 except that the structure 56 has both an MD layer 36 formed between the radiator 27 and the PCB carrier 33 and an MD layer 47 formed on top of the radiator 27. That is, the radiator 27 is embedded between the MD layers 36 and 47. A structure 56, such as is depicted by FIG. 4, in which the radiator 27 is embedded between MD layers 36 and 47 shall be referred to herein as an "embedded structure."

In each of the embodiments shown in FIGS. 2-4, the presence of an MD layer enhances EM energy radiation by lowering the EM energy concentrated on the flexible PCB carrier 33, thereby permitting an increase in antenna gain and a reduction in the size of the antenna structures and, specifically, the radiator 27 for a given level of antenna performance. Indeed, the MD layer can lead to antenna miniaturization by a factor of the refractive index ($n=(\mu_r\varepsilon_r)^{0.5}$).

Generally, antenna size is proportional to the wavelength ($\lambda$) of the incident wave, which can be shortened by the refractive index (n) of the medium. An MD layer having both $\mu_r$ and $\varepsilon_r$ can miniaturize an antenna, according to $\lambda=\lambda_0/(\mu_r\varepsilon_r)^{0.5}$, where $\lambda_0$ is the wavelength in free space. In addition, bandwidth and impedance matching characteristics can be improved with the $\mu_r$ of the antenna substrate.

Figure 5A:
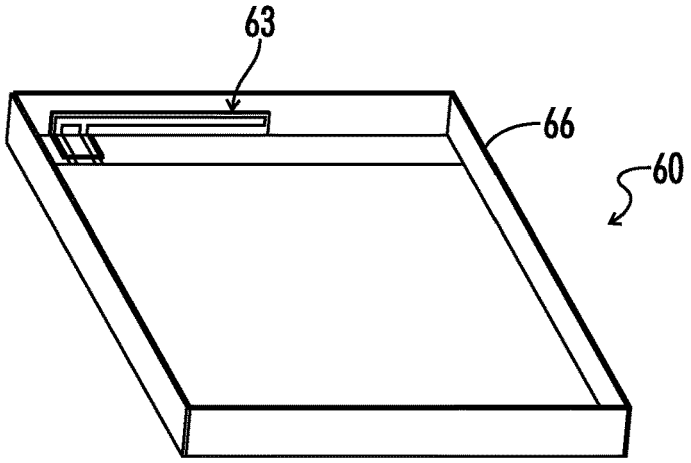
FIG. 5A depicts an exemplary embodiment of a flexible magnetic single-input single-output (SISO) antenna element.
Figure 5B:
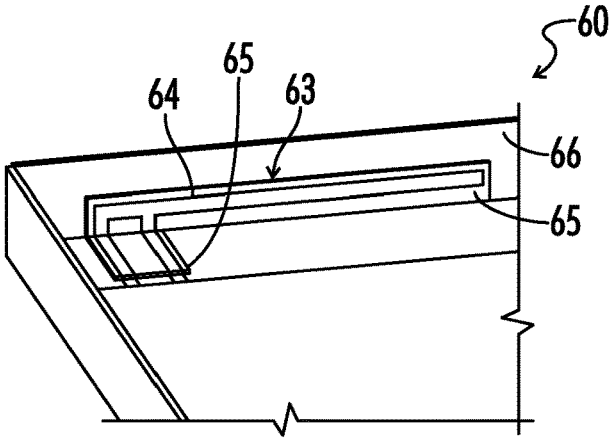
FIG. 5B depicts the flexible magnetic SISO antenna element illustrated by FIG. 5A.
Figure 5C:
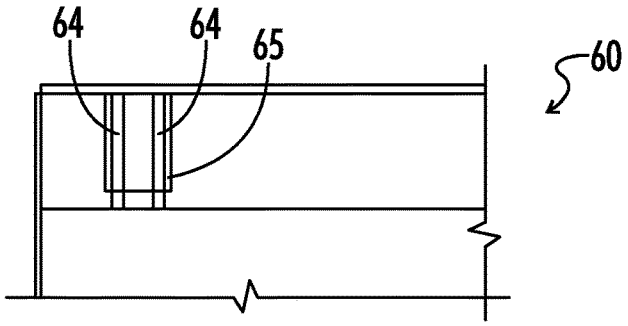
FIG. 5C is a top view depicting the flexible magnetic SISO antenna element illustrated by FIG. 5A.

FIGS. 5A-5C depict an exemplary embodiment of a flexible magnetic SISO antenna element 60 having a substrate structure 63 similar to the structure 26 shown by FIG. 2. Specifically, the substrate structure 63 has a radiator 64 formed on an MD layer 65. Such substrate structure 63 is formed on an inner wall of a non-conductive (e.g., plastic) housing 66. Note that the housing 66 is shown with a top of the housing 66 removed for illustrative purposes in order to show components normally hidden from view. In actuality, the housing 66 may completely enclose the flexible magnetic SISO antenna element 60. Further, the transceiver 22 (not shown in FIGS. 5A-5C for simplicity of illustration) may reside within the housing 66 and be conductively coupled to the radiator 64.

Figure 6A:
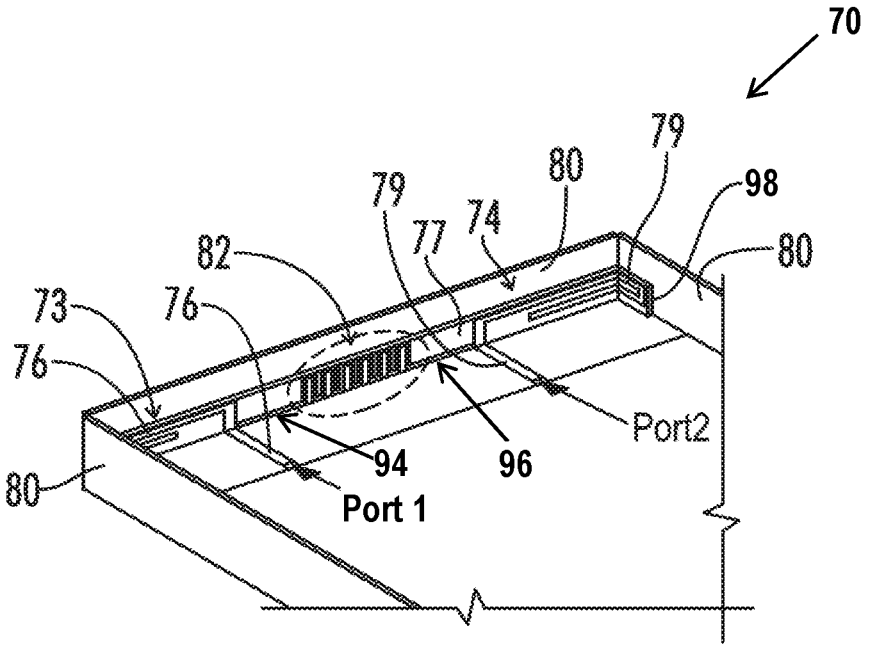
FIG. 6A depicts an exemplary embodiment of a flexible magnetic multiple-input multiple-output (MIMO) antenna element.
Figure 6B:
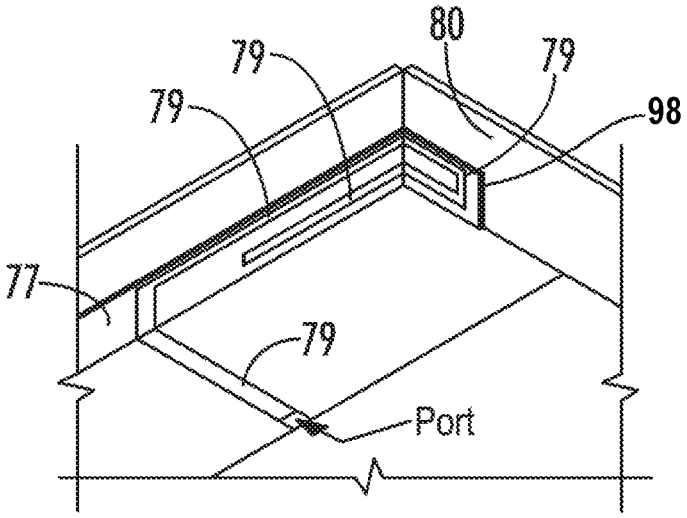
FIG. 6B depicts the flexible magnetic MIMO antenna element illustrated by FIG. 6A.

FIGS. 6A-6B depict an exemplary embodiment of a flexible magnetic MIMO antenna element 70 having substrate structures 73 and 74 similar to the structure 26 shown by FIG. 2. Specifically, the substrate structure 73 has a radiator 76 formed on an MD layer 77 and a flexible printed circuit board 98, and the substrate structure 74 has a radiator 79 formed on the MD layer 77 and the flexible printed circuit board 98. Such substrate structures 73 and 74 are formed on a non-conductive (e.g., plastic) housing 80. Note that, like the housing 66 shown by FIG. 5A, the housing 80 is shown in FIGS. 6A-6B with a top of the housing 80 removed for illustrative purposes in order to show components normally hidden from view. In actuality, the housing 80 may completely enclose the flexible magnetic MIMO antenna element 70. Further, the transceiver 22 (not shown in FIGS. 6A-6B for simplicity of illustration) may reside within the housing 80 and be conductively coupled to the radiators 76 and 79.

In addition, a decoupling network 82 is formed on the MD layer 77 between the substrate structures 73 and 74. The decoupling network 82 comprises conductive material that is coupled by connectors 94, 96 to each radiator 76 and 79 and forms a planar coil having a number of turns, as shown by FIG. 6A.

Figure 7A:
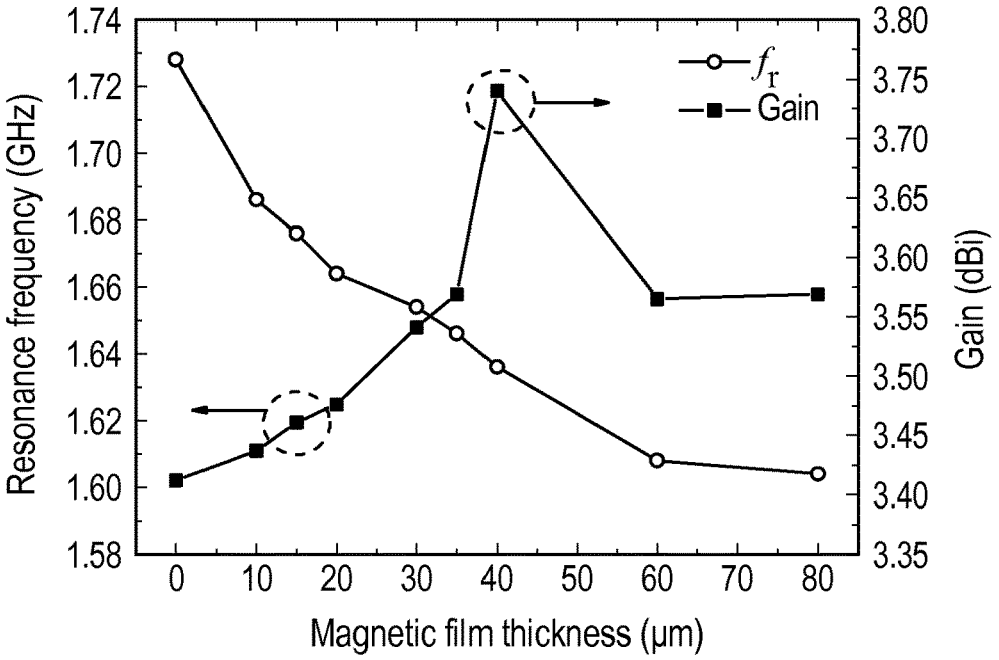
FIG. 7A is a graph illustrating simulated resonance frequency and antenna gain for a range of magnetic film thickness in a substrate structure.
Figure 7B:
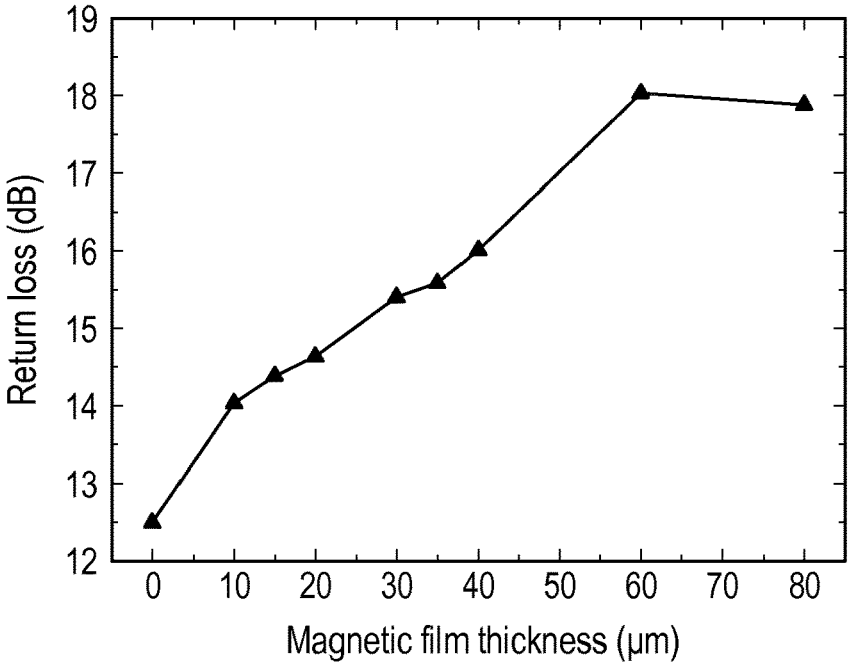
FIG. 7B is a graph illustrating simulated return loss for a range of magnetic film thickness in a substrate structure.
Figure 8A:
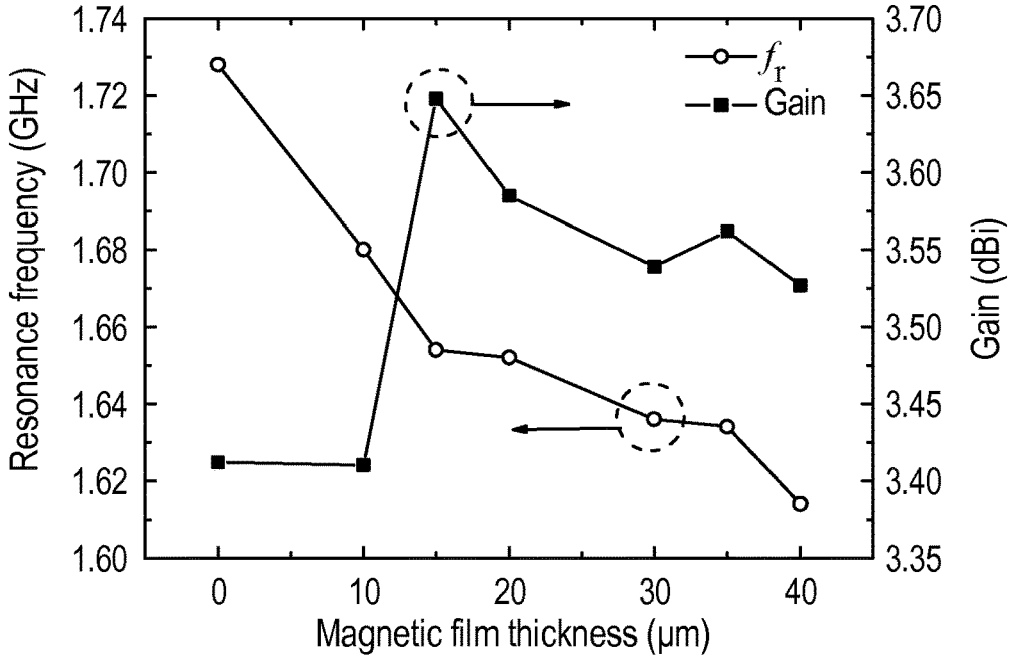
FIG. 8A is a graph illustrating simulated resonance frequency and antenna gain for a range of magnetic film thickness in an overleaf structure.
Figure 8B:
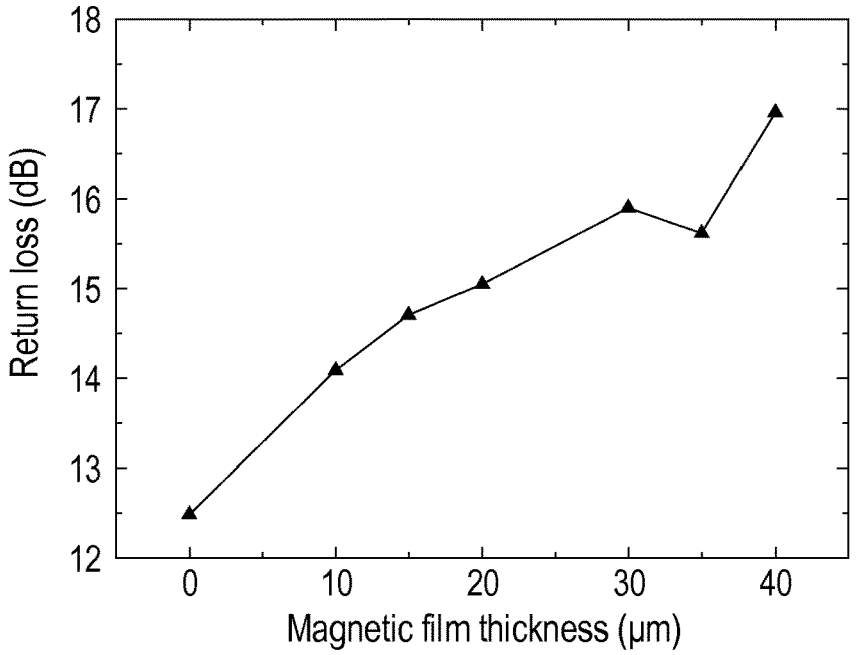
FIG. 8B is a graph illustrating simulated return loss for a range of magnetic film thickness in an overleaf structure.
Figure 9A:
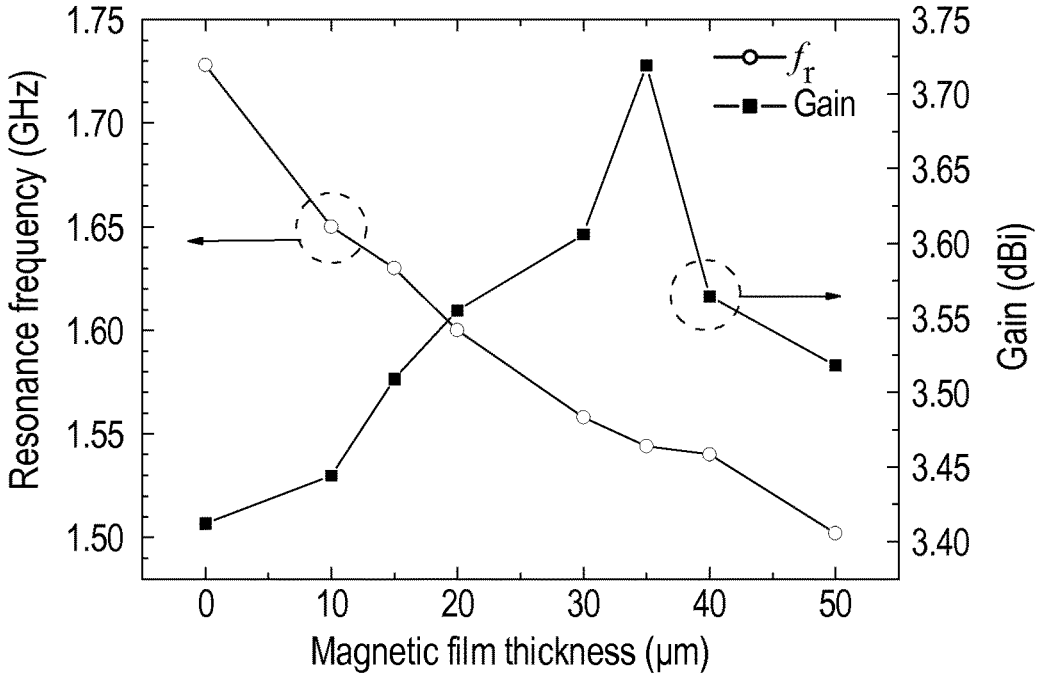
FIG. 9A is a graph illustrating simulated resonance frequency and antenna gain for a range of magnetic film thickness in an embedded structure.
Figure 9B:
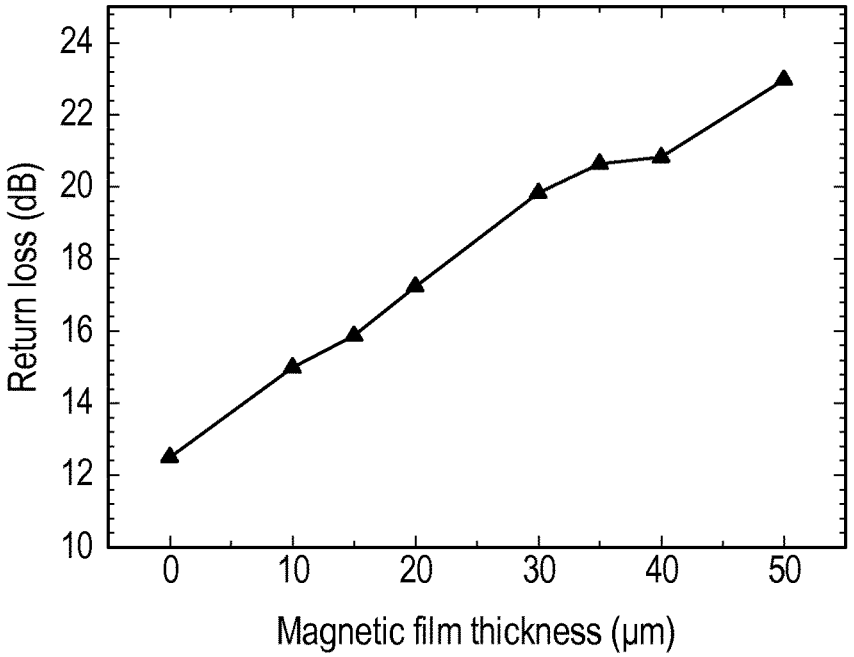
FIG. 9B is a graph illustrating simulated return loss for a range of magnetic film thickness in an embedded structure.

Simulated antenna performance for a substrate structure 26 is shown by FIGS. 7A-7B, and simulated antenna performance for an overleaf structure 46 is shown by FIGS. 8A-8B. Further, simulated antenna performance for an embedded structure 56 is shown by FIGS. 9A and 9B. It is noted that antenna gain shows a peaking effect as the magnetic film thickness (i.e., the thickness of the MD layer) is increased for all antenna types, while the resonant frequency decreases monotonously with the magnetic film thickness. This confirms that higher gain and larger miniaturization factor than a flexible dielectric antenna can be achieved using the MD layer. In addition, the return loss increases with the magnetic film thickness, thereby improving the antenna impedance matching. There exists an optimal thickness for achieving the highest antenna gain, which is dependent on the antenna structure. For example, the peak gain from the substrate structure in FIG. 7A was about 3.74 dBi at 40 μm thick MD layer, which is much higher than about 3.41 dBi for a dielectric substrate antenna structure. Accordingly, the gain of a flexible magnetic antenna structure is much higher than that of a flexible dielectric antenna structure.

Figure 10:
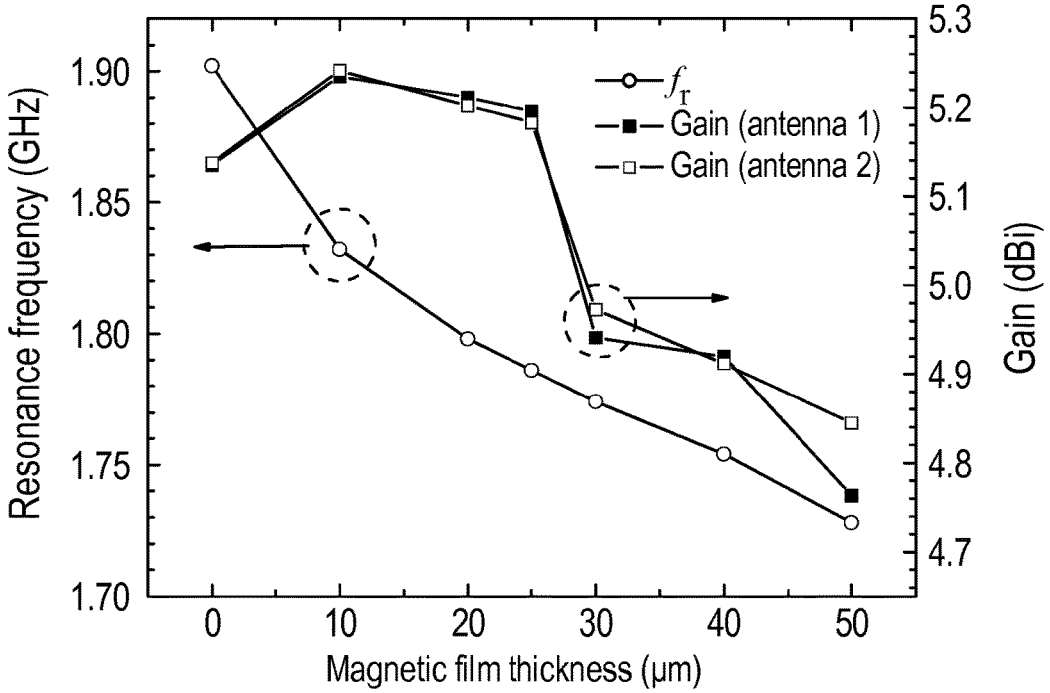
FIG. 10 is a graph illustrating simulated resonance frequency and antenna gain for a range of magnetic film thickness in a flexible magnetic MIMO antenna element.

In order to increase data transfer rate, two types of flexible MIMO antenna elements were designed and tested. One such element ("antenna 1") had a flexible magnetic antenna structure 26, as shown by FIG. 2, and the other element ("antenna 2") had a flexible dielectric antenna structure. Results of the testing are shown in FIG. 10. As shown by FIG. 10, the antenna resonant frequency decreases with increasing magnetic film thickness, thereby implying that the antenna size can be reduced like an SISO antenna. Therefore, antenna miniaturization can be achieved, and further separation between two antenna structures is allowed, thereby decreasing the mutual coupling and increasing isolation. The design of a complex decoupling network can be simplified or eliminated through the presence of an MD layer.

Figure 11A:
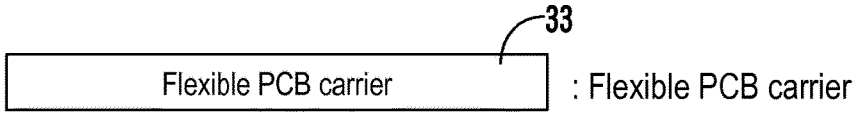
FIG. 11A depicts an exemplary embodiment of a flexible magnetic antenna structure after formation of a flexible printed circuit board (PCB) carrier.
Figure 11B:
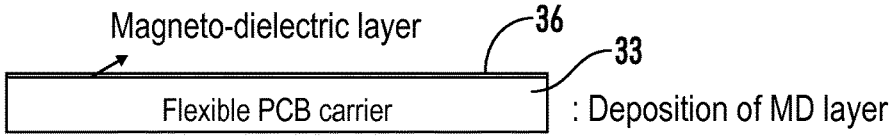
FIG. 11B depicts an exemplary embodiment of the flexible magnetic antenna structure of FIG. 11A after deposition of a magneto-dielectric (MD) layer on the PCB carrier.
Figure 11C:
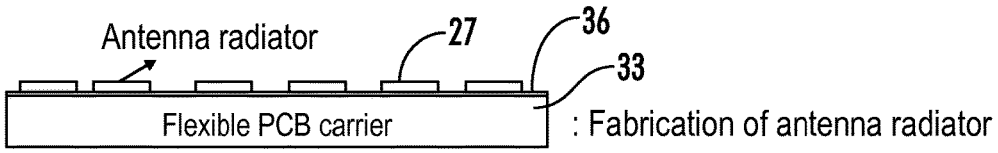
FIG. 11C depicts an exemplary embodiment of the flexible magnetic antenna structure of FIG. 11B after fabrication of an antenna radiator on the MD layer.
Figure 11D:
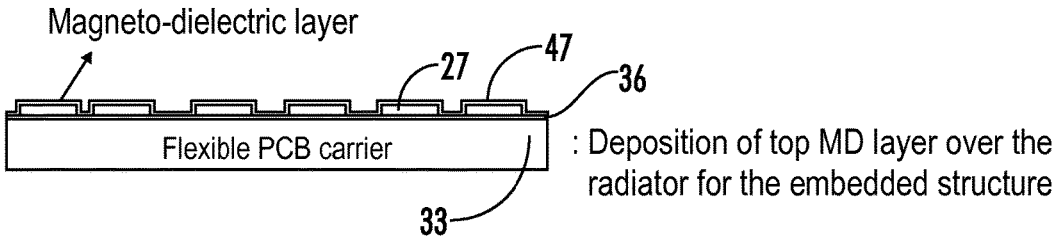
FIG. 11D depicts an exemplary embodiment of the flexible magnetic antenna structure of FIG. 11C after deposition of a top MD layer over the antenna radiator depicted by FIG. 11C.

FIGS. 11A-11D depict an embedded structure at different stages during fabrication. First, an MD layer 36 less than approximately 50 micrometers (μm) is deposited on a flexible PCB carrier 33, as shown by FIGS. 11A-11B, followed by patterning of an antenna radiator 27, as shown by FIG. 11C. The radiator 27 is conductively coupled to connection 29 (FIG. 1), and an MD layer 47 less than approximately 50 μm is then deposited such that the radiator 27 is embedded between MD layers 36 and 47, as shown by FIG. 11D. Note that, in one embodiment, the flexible PCB carrier 33 generally withstands temperature up to about 400 degrees Celsius (C.). Thus, a low-temperature deposition process, such as screen printing, ferrite spin-spray, and aerosol deposition, can be used for MD layer deposition. The radiator 27 may be fabricated using electroplating, sputtering deposition, and other deposition techniques can be used with photolithography process or other mask fabrication processes. In other embodiments, other types of microfabrication techniques can be used, and other dimensions of the components of the antenna structure are possible. Further, similar manufacturing techniques may be used for the substrate structure and overleaf structure.

In various embodiments described above, substrate 33 is described as a flexible PCB carrier. However, it should be emphasized that other types of substrates are possible in other embodiments. Indeed, it is not necessary for the substrate 33 to be flexible. Further, while it is generally desirable for the substrate 33 to be composed of dielectric material, non-dielectric substrates may be used, if desired.

Now, therefore, the following is claimed:

1. A communication system, comprising:

a transceiver; and a magnetic antenna structure having a flexible printed circuit board, a first magneto-dielectric layer, a second magneto-dielectric layer separate from the first magneto-dielectric layer, a first conductive radiator, a second conductive radiator, and a decoupling network, wherein the first conductive radiator and the second conductive radiator are conductively coupled to the transceiver for wirelessly radiating an electrical signal from the transceiver, wherein the first magneto-dielectric layer is positioned in contact with the first conductive radiator, the second conductive radiator and the flexible printed circuit board, wherein the decoupling network is coupled to the first conductive radiator and the second conductive radiator, wherein the second magneto-dielectric layer is positioned such that the first conductive radiator and the second conductive radiator are each embedded between the first magneto-dielectric layer and the second magneto-dielectric layer, and wherein the first magneto-dielectric layer and the second magneto-dielectric layer each comprise magnetic material having a relative permeability greater than 1 and a relative permittivity greater than 1.

2. The system of claim 1, wherein the first magneto-dielectric layer comprises a hexagonal ferrite.

3. The system of claim 1, wherein the decoupling network is conductively coupled to the first conductive radiator and the second conductive radiator.

4. The system of claim 1, wherein the magnetic antenna structure is a multiple-input, multiple-output (MIMO) antenna structure.

5. The system of claim 1, wherein the first magneto-dielectric layer comprises a spinel ferrite.

6. The system of claim 5, wherein the spinel ferrite is selected from at least one of the group including: Ni-Zn, Mn-Zn, Ni-Zn-Cu, Ni-Mn-Co, Co, Li-Zn, and Li-Mn.

7. The system of claim 1, wherein the decoupling network is formed on the first magneto-dielectric layer.

8. A communication method, comprising:

transmitting an electrical signal from a transceiver to a magnetic antenna structure having a flexible printed circuit board, a first magneto-dielectric layer, a second magneto-dielectric layer separate from the first magneto-dielectric layer, a first conductive radiator, a second conductive radiator, and a decoupling network, wherein at least the first magneto-dielectric layer is positioned in contact with the first conductive radiator, the second conductive radiator and the flexible printed circuit board, wherein the decoupling network is coupled to the first conductive radiator and the second conductive radiator, wherein the second magneto-dielectric layer is positioned such that the first conductive radiator and the second conductive radiator are each embedded between the first magneto-dielectric layer and the second magneto-dielectric layer, and wherein the first magneto-dielectric layer and the second magneto-dielectric layer each comprise magnetic material having relative permeability greater than 1 and a relative permittivity greater than 1; and wirelessly radiating the electrical signal from at least one of the first conductive radiator and the second conductive radiator.

9. The method of claim 8, wherein the first magneto-dielectric layer comprises a hexagonal ferrite.

10. The method of claim 8, wherein the decoupling network is conductively coupled to the first conductive radiator and the second conductive radiator.

11. The method of claim 8, wherein the magnetic antenna structure is a multiple-input, multiple-output (MIMO) antenna structure.

12. The method of claim 8, wherein the first magneto-dielectric layer comprises a spinel ferrite.

13. The method of claim 12, wherein the spinel ferrite is selected from at least one of the group including: Ni-Zn, Mn-Zn, Ni-Zn-Cu, Ni-Mn-Co, Co, Li-Zn, and Li-Mn.

14. The method of claim 8, wherein the decoupling network is formed on the first magneto-dielectric layer.

15. A communication system, comprising:

a transceiver; and a magnetic antenna structure having a flexible printed circuit board, a first magneto-dielectric layer, a second magneto-dielectric layer, and a conductive radiator, wherein the radiator is conductively coupled to the transceiver for wirelessly radiating an electrical signal from the transceiver, wherein the first magneto-dielectric layer is positioned on the flexible printed circuit board, the radiator is positioned on the first magneto-dielectric layer and the second magneto-dielectric layer is positioned on the radiator, and wherein the first magneto-dielectric layer and the second magneto-dielectric layer each comprise magnetic material having a relative permeability greater than 1 and a relative permittivity greater than 1.

16. The system of claim 15, wherein the first magneto-dielectric layer has a thickness of about 50 micrometers and the second magneto-dielectric layer has a thickness of about 50 micrometers or less.

* * * * *